US005967104A

United States Patent [19]

Nakayoshi et al.

[11] Patent Number: 5,967,104

[45] Date of Patent: Oct. 19, 1999

[54] VALVE TIMING CONTROL DEVICE

[75] Inventors: Hideki Nakayoshi, Kariya; Naoki Kira, Anjo, both of Japan

[73] Assignee: Aisin Seiki Kabushiki Kaisha, Aichi-pref., Japan

[21] Appl. No.: 09/104,433

[22] Filed: Jun. 25, 1998

[30] Foreign Application Priority Data

Jun. 30, 1997 [JP] Japan ..... 9-174182

[51] Int. Cl.[6] ..... F01L 1/344

[52] U.S. Cl. ..... 123/90.17; 123/90.31

[58] Field of Search ..... 123/90.15, 90.17, 123/90.19, 90.31; 74/568 R; 464/1, 2, 160

[56] References Cited

U.S. PATENT DOCUMENTS 5,666,914 9/1997 Ushida et al. ..... 123/90.17

FOREIGN PATENT DOCUMENTS 1-92504 4/1989 Japan .
2-50105 4/1990 Japan .
9-60508 3/1997 Japan .
10-47022 2/1998 Japan .

*Primary Examiner*—Weilun Lo
*Attorney, Agent, or Firm*—Hazel & Thomas, P.C.

[57] ABSTRACT

A valve timing control device for controlling the opening/closing timing of the intake valve or exhaust valve incorporates a valve opening/closing rotary shaft, a rotor provided on the rotary shaft, a timing pulley for receiving rotational power from a crank pulley through a timing belt, a rotation transmitting member provided within the timing pulley and mounted around the rotary shaft to rotate within a predetermined range, a plurality of vanes provided on the rotor or the rotation transmitting member, a fluid chamber formed between the rotor and the rotation transmitting member and separated into advancing chambers and delaying chambers by the vanes, a first fluid passage communicating with the advancing chambers, a second fluid passage communicating with the delaying chambers, and a cooling mechanism for cooling the rotation transmitting member and/or the timing pulley.

3 Claims, 3 Drawing Sheets

VALVE TIMING CONTROL DEVICE

BACKGROUND OF THE INVENTION

1. Field of the Invention

The present invention relates to a valve timing control device to be used for controlling the opening/closing timing of an intake valve or an exhaust valve in a valve actuating mechanism of an internal combustion engine.

2. Description of the Related Art

In Unexamined Published Japanese Patent Application No. Hei 1-92504 or Unexamined Published Japanese Utility Model Application No. Hei 2-50105, for example, there is disclosed a valve timing control device of that kind comprising: a valve opening/closing rotary shaft rotatably assembled with the cylinder head of the internal combustion engine; a rotor integrally provided on the rotary shaft; a timing pulley for transmitting rotational power from a crank pulley through a timing belt; a rotational transmitting member integrally provided within the timing pulley, which is mounted around the peripheral surface of the rotary shaft, so as to rotate within a predetermined range for transmitting the rotational power from the crank pulley; a plurality of vanes provided on the rotor or the rotational transmitting member; a fluid chamber formed between the rotor and the rotational transmitting member and separated into advancing chambers and delaying chambers by the vanes; first fluid passages for feeding and discharging a fluid to and from the advancing chambers; and second fluid passages for feeding and discharging the fluid to and from the delaying chambers.

In the valve timing control device, as described in each of the above-cited patent applications, the rotational transmitting member includes an external rotor, a front plate and a rear plate. The fluid chamber is formed between the rotor and the external rotor and separated into advancing chambers and delaying chambers by the vanes. Working fluid is fed to or discharged from the advancing chambers and delaying chambers. The timing pulley is disposed outside of the external rotor.

The timing belt is located between the crank pulley and the timing pulley. The timing belt, the crank pulley and the timing pulley are all disposed in a timing belt case. The timing belt case is attached on the side of the cylinder block and on the front side of the cylinder head. When the internal combustion engine is driven, the temperature of the atmosphere inside the timing belt case reaches about 80 degrees centigrade. On the other hand, the working fluid, which is used as lubricating oil, reaches from about 120 degrees centigrade to 130 degrees centigrade, when the internal combustion engine is driven. In the valve timing control device, as described in each of the above-cited patent applications, the working fluid heats the rotational transmitting member and the timing pulley. This heat might damage the timing belt made of a resin or a rubber and shorten the lifespan of the timing belt.

SUMMARY OF THE INVENTION

The invention has been conceived to solve the above-specified problems. According to the invention, there is provided a valve timing control device for controlling the opening/closing timing of an intake valve or exhaust valve of an internal combustion engine comprising, a valve opening/closing rotary shaft rotatably assembled with the cylinder head of the internal combustion engine, a rotor integrally provided on the rotary shaft, a timing pulley for receiving rotational power from a crank pulley through a timing belt, a rotational transmitting member integrally provided within the timing pulley and mounted around the rotary shaft, so as to rotate within a predetermined range, a plurality of vanes provided on the rotor or the rotational transmitting member, a fluid chamber formed between the rotor and the rotational transmitting member and separated into advancing chambers and delaying chambers by the vanes, first fluid passages for feeding and discharging a fluid to and from the advancing chambers, second fluid passages for feeding and discharging the fluid to and from the delaying chambers, and a cooling mechanism for cooling the rotational transmitting member and/or the timing pulley.

Other and further objects, features and advantages of the invention will appear more fully from the following description.

DESCRIPTION OF THE PREFERRED EMBODIMENTS

One embodiment of the invention will be described with reference to the accompanying drawings.

Figure 1:
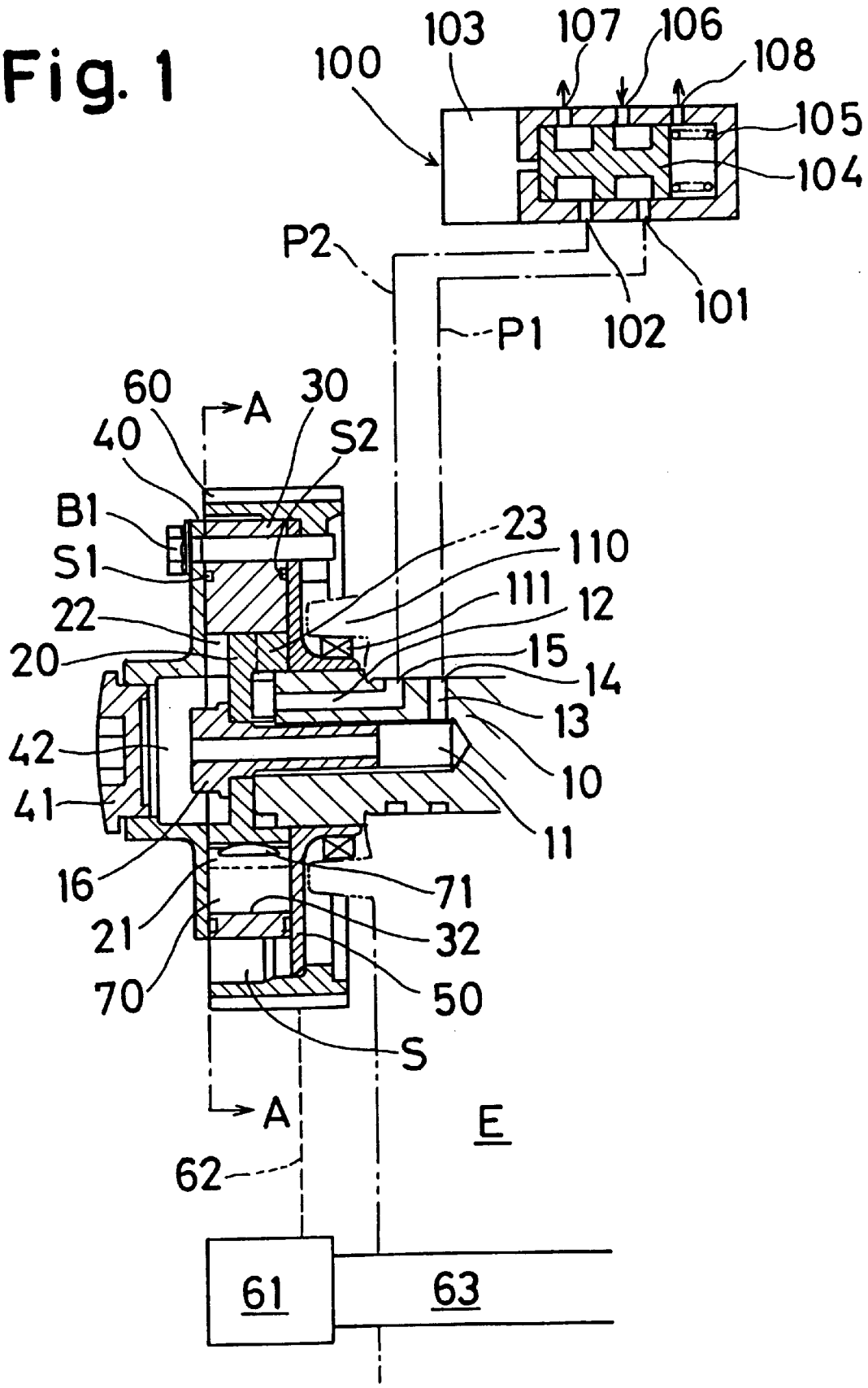
FIG. 1 is a longitudinal section schematically showing one embodiment of a valve timing control device according to the invention.
Figure 2:
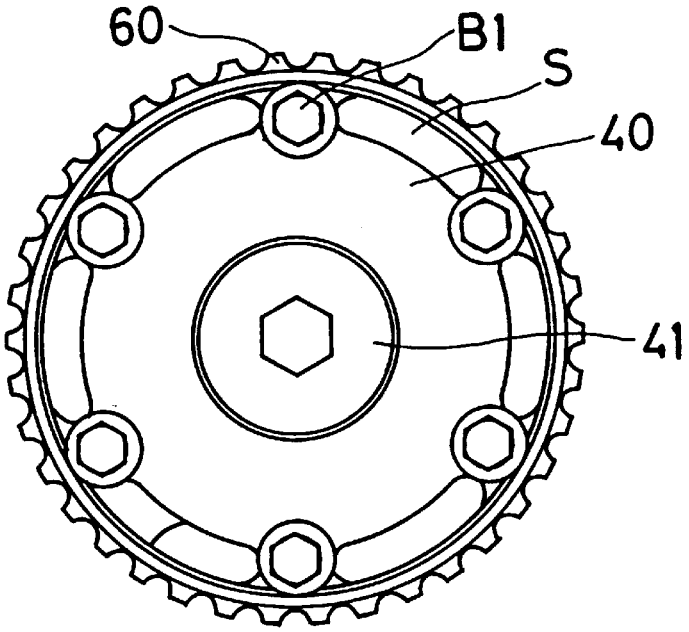
FIG. 2 is a side view showing an essential portion of FIG. 1.
Figure 3:
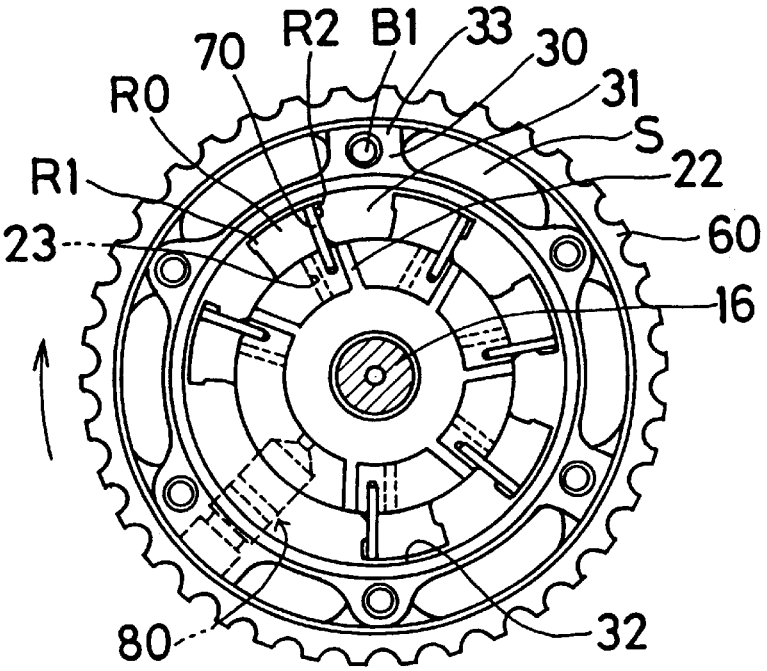
FIG. 3 is a section taken along line A—A of FIG. 1.

A valve timing control device according to the invention, as shown in FIGS. 1 to 3, is constructed so as to comprise a valve opening/closing shaft including a cam shaft 10 rotatably supported by a cylinder head 110 of an internal combustion engine E, and an internal rotor 20 integrally provided on the leading end portion of the cam shaft 10; a rotational transmitting member mounted around the rotary shaft so as to rotate relative thereto within a predetermined range and includes an external rotor 30, a front plate 40, a cap 41, a rear plate 50 and a timing pulley 60. Six vanes 70 are assembled with the internal rotor 20. A lock mechanism 80 is assembled with the internal rotor 20 and the external rotor 30. The timing pulley 60 is constructed, as shown in FIG. 1, to transmit the rotational power in the clockwise direction of FIG. 3 from the crank pulley 61 through a timing belt 62 made of resin or rubber. The crank pulley 61 is provided on a crank shaft 63 of the internal combustion engine E.

The cam shaft 10 is equipped with the well-known cam (although not shown) for opening/closing an intake valve or an exhaust valve (although not shown) and is provided therein with an advance passage 12 and a delay passage 11, which extend in the axial direction of the cam shaft 10. The advance passage 12 is connected to a connection port 102 of a change-over valve 100 via an annular passage 15 and a connection passage P2. On the other hand, the delay passage 11 is connected to a connection port 101 of the change-over valve 100 via a radial passage 13, an annular passage 14 and a connection passage P1.

The change-over valve 100 is able to move the spool 104 rightward within FIG. 1 against the action of a spring 105 by energizing a solenoid 103. The change-over valve 100 is so constructed as to establish, when de-energized, communication between a feed port 106, as connected to an oil pump (although not shown) to be driven by the internal combustion engine E, and the connection port 101, and communication between the connection port 102 and an exhaust port 107 and further as to establish, when energized, the communication between the feed port 106 and the connection port 102 and communication between the connection port 101 and an exhaust port 108. As a result, the working oil is fed to the advance passage 12, when the solenoid 103 is energized, and to the delay passage 11 when the same is de-energized.

The internal rotor 20 is integrally fixed to the cam shaft 10 by means of a hollow bolt 16 and is provided with vane grooves 21 for mounting the six vanes 70 individually in radial directions. Further provided are passages 23 for feeding/discharging the working oil to and from advancing chambers R1, as defined by the individual vanes 70, via the advance passage 12; and passages 22 for feeding/discharging the working oil to and from delaying chambers R2, as defined by the individual vanes 70, via the delay passage 11. Here, each vane 70 is urged radially outward by a spring 71 (as shown in FIG. 1) fitted in the bottom portion of the vane groove 21. The lock mechanism 80 is able to engage between the internal rotor 20 and the external rotor 30, where both of the internal rotor 20 and the external rotor 30 are synchronized in a predetermined phase. The predetermined phase is the most advanced position as shown in FIG. 3. In this embodiment, the working oil under pressure in the advance passage 12 is able to cancel the engagement of the lock mechanism 80.

In the inner circumference of the external rotor 30, the external rotor 30 is assembled with the outer circumference of the internal rotor 20 so as to rotate within a predetermined range. To the two sides of the external rotor 30, there are joined the front plate 40 and the rear plate 50 through seam members SI and S2. The external rotor 30 is integrally joined to the internal rotor 20 together with the timing pulley 60 by means of six bolts B13. With the front plate 40, the cap 41 is assembled liquid-tightly to form a passage 42 for connecting the delay passage 11 of the cam shaft 10 and the passages 22 of the internal rotor 20. In the external rotor 30, on the other hand, there are six concave portions 32 forming fluid pressure chambers R0 to accommodate the individual vanes 70 and adapted to be separated into the advancing chambers R1 and the delaying chambers R2 by the individual vanes 70.

As shown in FIGS. 2 and 3, the external rotor 30 includes six outwardly directed projections 33 which are located on the outer peripheral surface of the external rotor 30 at equal intervals. Each projection 33 has a hole for inserting the bolt B1. On the other hand, both the front plate 40 and the rear plate 50 include six outwardly directed projections which are located on the peripheral surface thereof at the same intervals as the projections 33 of the external rotor 30. Each projection has a hole for inserting a bolt B1. The bolts B1 are inserted into the holes of these projections and screwed into the timing pulley 60. Therefore, six cavities S are formed between the outer peripheral surface of the external rotor 30 and the inner peripheral surface of the timing pulley 60.

In the valve timing control device constructed according to this embodiment, the change-over valve 100 in the state shown in FIG. 1 controls the working oil feeding from the change-over valve 100 to either the advancing chambers R1 or the delaying chambers R2. When the working oil is fed from the change-over valve 100 to the advancing chambers R1, the phase is at the most advanced position (the vanes 70 are individually attached at the rotary directional side wall of the concave portions 32) as shown in FIG. 3. When the working oil is fed from the change-over valve 100 to the delaying chambers R2, the phase is at the most delayed position (the vanes 70 are individually attached at the anti-rotary directional side wall of the concave portions 32).

Hence, the timing belt 62, the crank pulley 61 and the timing pulley 60 are disposed into a timing belt case (not shown). The timing belt case is attached to the side of the cylinder block and on the front side of the cylinder head 100. When the internal combustion engine E is driven, the temperature of the atmosphere inside the timing belt case is about 80 degrees centigrade. On the other hand, the working oil, which is used as lubricating oil, is from about 120 degrees centigrade to 130 degrees centigrade, when the internal combustion engine E is driven. In the high temperature of the atmosphere, the cavities S are disposed between the outer peripheral surface of the external rotor 30 and the inner peripheral surface of the timing pulley 60. This provides the radiation area of the external rotor 30 and the timing pulley 60. In addition, the heat transmitted from the working oil to the timing pulley 60 through the external rotor 30 is minimized. Therefore, the cavities S prevent the timing pulley 60 from being heated, thereby prolonging the lifespan of the timing belt 62 made of a resin or rubber.

Figure 4:
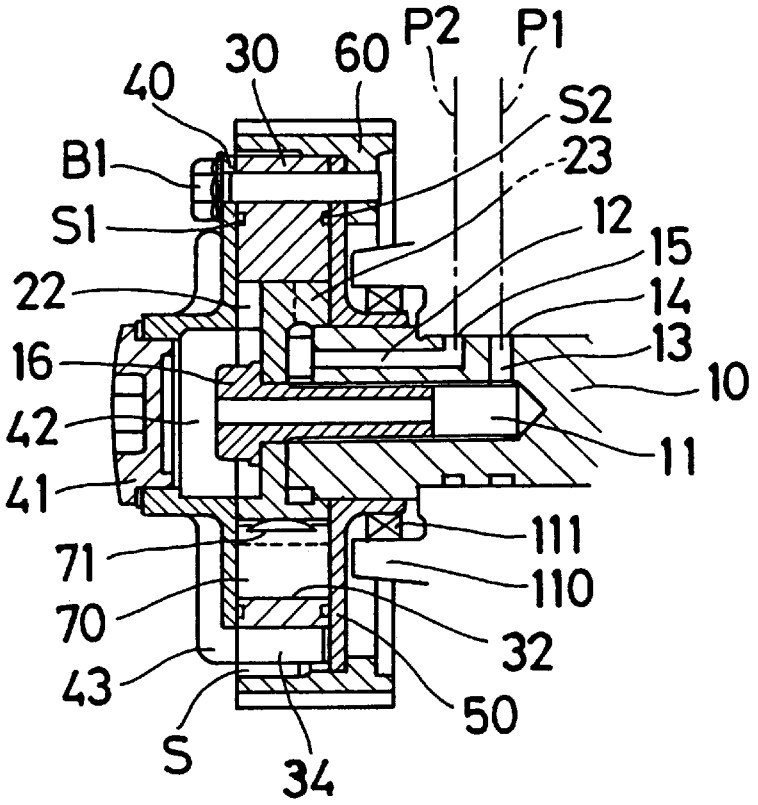
FIG. 4 is a longitudinal section schematically showing another embodiment of a valve timing control device according to the invention.
Figure 5:
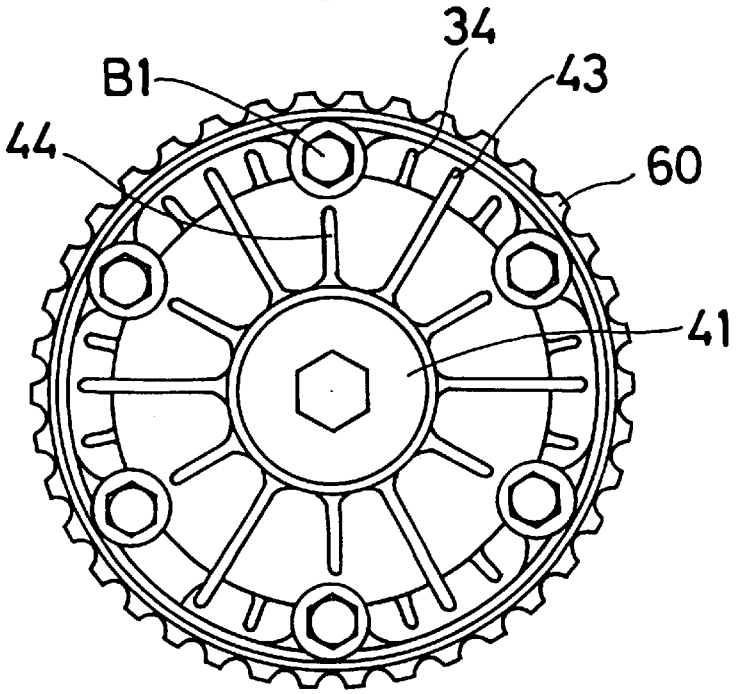
FIG. 5 is a side view showing an essential portion of FIG. 4.

FIGS. 4 and 5 illustrate another modified version of the preferred embodiment, in which a specific arrangement of a cooling mechanism is used. In FIGS. 4 and 5, the same parts shown in FIGS. 1 to 3 are used with the same numerals. In this embodiment, there are a plurality of cooling fins 34 which are disposed on the outer peripheral surface of the external rotor 30. Further, there are a plurality of cooling fins 43 and 44 which are arranged on the front side surface of the front plate 40. As a result, the radiation area of the external rotor 30 and the front plate 40 is able to be increased by means of the fins 34, 43 and 44. The heat transmitted from the working oil to the timing pulley 60 through the external rotor 30 is minimized. Therefore, the fins 34, 43 and 44 prevent the timing pulley 60 from being heated, thereby also prolonging the lifespan of the timing belt 62 made of a resin or rubber.

What is claimed is:

1. A valve timing control device for controlling the opening and closing timing of the intake valve or exhaust valve of an internal combustion engine, comprising;

a valve opening and closing rotary shaft rotatably assembled with a cylinder head of the internal combustion engine;

a rotor integrally provided on the rotary shaft;

a timing pulley for receiving rotational power from a crank pulley through a timing belt;

a rotational transmitting member integrally provided within the timing pulley and mounted around the rotary shaft, so as to rotate within a predetermined range;

a plurality of vanes provided on the rotor or the rotational transmitting member;

a plurality of fluid chambers formed between the rotor and the rotational transmitting member and separated into advancing chambers and delaying chambers by the vanes;

first fluid passages for feeding and discharging fluid under pressure to and from the advancing chambers;

second fluid passages for feeding and discharging fluid under pressure to and from the delaying chambers; and means for preventing heat transfer between the rotation transmitting member and the timing pulley, wherein the means including a plurality of peripherally spaced connecting elements fixedly connecting the timing pulley to the transmitting member and a cavity defined between the transmitting member, the timing pulley and the plurality of connecting elements, the cavity being further defined to extend in the axial direction of the rotary shaft.

2. A valve timing control device according to claim 1, wherein the cavity is defined between an outer peripheral surface of the rotational transmitting member and an inner peripheral surface of the timing pulley.

3. A valve timing control device comprising:

a valve opening and closing rotary shaft rotatably assembled with a cylinder head of an internal combustion engine;

a rotor integrally provided on the rotary shaft;

a timing pulley for receiving rotational power from a crank pulley through a timing belt, and having a plurality of projections which are inwardly projected from an inner peripheral surface of the timing pulley and which are located at predetermined intervals;

a rotational transmitting member mounted around the rotary shaft so as to rotate within a predetermined range, and having a plurality of projections which are outwardly projected from an outer peripheral surface of the rotational transmitting member and which are located at the same intervals as the projections of the timing pulley;

a connecting member for connecting the projections of the timing pulley to the projections of the rotational transmitting member so as to integrally rotate;

a vane provided on the rotor or the rotational transmitting member;

a fluid chamber formed between the rotor and the rotational transmitting member and divided into advancing chamber and delaying chamber by the vane; and a fluid supplying means for supplying fluid under pressure to at least a selected one of the advancing chamber and the delaying chamber.

* * * * *